US010665182B1

(12) United States Patent
Payne et al.

(10) Patent No.: US 10,665,182 B1
(45) Date of Patent: May 26, 2020

(54) EFFICIENT DATA TRANSMISSION IN ANALOG SPATIAL LIGHT MODULATORS

(71) Applicant: SILICON LIGHT MACHINES CORPORATION, Sunnyvale, CA (US)

(72) Inventors: Alexander Payne, Ben Lomond, CA (US); Gregory Myatt, Livermore, CA (US)

(73) Assignee: Silicon Light Machines Corporation, Sunnyvale, CA (US)

( * ) Notice: Subject to any disclaimer, the term of this patent is extended or adjusted under 35 U.S.C. 154(b) by 0 days.

(21) Appl. No.: 16/288,008

(22) Filed: Feb. 27, 2019

Related U.S. Application Data

(63) Continuation of application No. 15/291,890, filed on Oct. 12, 2016, now abandoned.

(51) Int. Cl.
*G09G 3/34* (2006.01)

(52) U.S. Cl.
CPC ..... *G09G 3/3433* (2013.01); *G09G 2340/00* (2013.01)

(58) Field of Classification Search
CPC ..... G02B 26/0841
See application file for complete search history.

(56) References Cited

U.S. PATENT DOCUMENTS

2002/0024714 A1* 2/2002 Sandstrom ..... G02B 26/0833 359/290
2014/0002887 A1* 1/2014 Yeung ..... G02B 26/00 359/291

* cited by examiner

*Primary Examiner* — Robin J Mishler
(74) *Attorney, Agent, or Firm* — William Nuttle

(57) ABSTRACT

A spatial light modulator (SLM) and methods of operating the same are described. The SLM includes an array of pixels formed on a substrate, each pixel including a one or more electrostatically operable optical modulators, a receiver, a memory coupled to the receiver, and a driver including a number of drive channels coupled to the memory. Each of the drive channels is coupled to one of the pixels to drive the optical modulators in the pixel to one of a number of discrete modulation levels. The receiver receives reduced depth programming data in a predetermined sequence whereby the location of the programming data in the received data sequence implies the associated pixel address within the pixel array. The memory includes look-up-table circuitry to convert the reduced depth programming data to full depth programming data. Generally, the receiver, memory and driver are integrally formed on the same substrate with the array.

19 Claims, 13 Drawing Sheets

Input Representation (Levels)

| Output Data Bit-Depth | | Bits → | 1 | 2 | 3 | 4 | 5 |
|---|---|---|---|---|---|---|---|
| Bits ↓ | | Levels | 2 | 4 | 8 | 16 | 32 |
| 1 | 2 | | 1.000 | | | | |
| 2 | 4 | | 0.500 | 1.000 | | | |
| 3 | 8 | | 0.333 | 0.667 | 1.000 | | |
| 4 | 16 | | 0.250 | 0.500 | 0.750 | 1.000 | |
| 5 | 32 | | 0.200 | 0.400 | 0.600 | 0.800 | 1.000 |
| 6 | 64 | | 0.167 | 0.333 | 0.500 | 0.667 | 0.833 |
| 7 | 128 | | 0.143 | 0.286 | 0.429 | 0.571 | 0.714 |
| 8 | 256 | | 0.125 | 0.250 | 0.375 | 0.500 | 0.625 |
| 9 | 512 | | 0.111 | 0.222 | 0.333 | 0.444 | 0.556 |
| 10 | 1024 | | 0.100 | 0.200 | 0.300 | 0.400 | 0.500 |

no compression

Relative Data Rate

*FIG. 10A*

Input Representation (Levels)

| Output Data Bit-Depth | | Bits → | 1 | 2 | 3 | 4 | 5 |
|---|---|---|---|---|---|---|---|
| Bits ↓ | | Levels | 2 | 4 | 8 | 16 | 32 |
| 1 | 2 | | 0 | | | | |
| 2 | 4 | | 4 | 0 | | | |
| 3 | 8 | | 6 | 12 | 0 | | |
| 4 | 16 | | 8 | 16 | 32 | 0 | |
| 5 | 32 | | 10 | 20 | 40 | 80 | 0 |
| 6 | 64 | | 12 | 24 | 48 | 96 | 192 |
| 7 | 128 | | 14 | 28 | 56 | 112 | 224 |
| 8 | 256 | | 16 | 32 | 64 | 128 | 256 |
| 9 | 512 | | 18 | 36 | 72 | 144 | 288 |
| 10 | 1024 | | 20 | 40 | 80 | 160 | 320 |

Per Pixel Memory Requirements (bits)

*FIG. 10B*

EFFICIENT DATA TRANSMISSION IN ANALOG SPATIAL LIGHT MODULATORS

CROSS-REFERENCE TO RELATED APPLICATIONS

This application is a continuation of U.S. application Ser. No. 15/182,203, filed Jun. 12, 2016, which is incorporated by reference herein in its entirety.

TECHNICAL FIELD

The present invention relates generally to spatial light modulators (SLMs), and more particularly to analog SLMs and methods for operating the same for efficient data transmission in spatial light modulators.

BACKGROUND

A spatial light modulator (SLM) is a device that spatially varies or modulates a beam of light reflected therefrom or transmitted therethrough. An SLM is typically used in conjunction with a coherent light source, such as a laser, to modulate an intensity of the beam, a phase of the beam or both simultaneously. Spatial light modulators are widely used and growing in popularity for a number of different applications including printing, imaging or display and photolithography systems used in semiconductor fabrication.

Spatial light modulators can be classified as either binary (on-off) or analog (gray-scale). The Digital Mirror Device (DMD) is an example of a reflective binary spatial light modulator. Light from a DMD pixel is either transmitted or blocked depending on which of two stable positions the micro-mirror assumes. Analog spatial light modulators are exemplified by the Grating Light Valve (GLV), the Planar Light Valve (PLV™), both of which are available from Silicon Light Machines Corporation of Sunnyvale, Calif., and by liquid crystal (LC) light modulators. In these devices, the intensity of transmitted light can be continuously varied between bright and dark states depending on the strength of the input drive voltage.

Typically, analog spatial light modulators are controlled by digital input codes in conjunction with a digital-to-analog converter (DAC). The resolution of the gray-scale is determined by the bit-depth of the DAC. For example, an 8-bit DAC provides $2^8$=256 grey-levels and a 10-bit DAC provides $2^{10}$=1024 gray levels. There can be a dedicated DAC per pixel, or a single DAC can be shared among pixels via time-multiplexing.

Schematics of intensity versus a digital-to-analog converter (DAC) response for a binary spatial light modulator and a conventional analog spatial light modulator are shown in FIGS. 1A and 1B respectively. Due to their analog nature, analog SLM's typically require much higher data transmission rates relative to binary spatial light modulators. For example, consider a 1 k×2 k pixel binary SLM operating at a 1 kHz frame rate. The control code driving each mirror is simply a 1 or a 0—only a single bit is needed per pixel. In this case the data rate is: (1 bit/pixel)×(1000×2000 pixels/frame)*(1000 frames/s)=2 Giga-bits/s. FIG. 1B illustrates DAC response in the same pixel array in a 10-bit analog SLM. In this case, the data rate is: (10 bits/pixel)×(1000×2000 pixels/frame)*(1000 frames/s)=20 Giga-bits/s. Not surprisingly, the bit depth associated with analog spatial light modulator directly impacts the net data rate to the SLM: at the same frame rate, the 10-bit analog SLM requires 10× higher data rate relative to the binary SLM.

Accordingly, there is a need for SLMs and a method for operating the same for efficient data transmission.

SUMMARY

In a first aspect a spatial light modulator is provided including a memory having a look-up-table circuitry to convert the reduced depth programming data to full depth programming data. Generally, the SLM includes an array of a plurality of pixels formed on a substrate, each pixel including one or more electrostatically operable optical modulators, a receiver, a memory coupled to the receiver, and a driver including a number of drive channels coupled to the memory. Each of the drive channels is coupled to one of the pixels to drive the optical modulators in the pixel to one of a number of discrete modulation levels. The receiver receives the reduced depth programming data. The programming data is typically received in a predetermined sequence whereby the location of the programming data in the received data sequence implies the associated pixel address within the pixel array. In this manner, the receiver may generate a pixel location address for each "reduced depth programming data value" that is received. The memory includes look-up-table circuitry to convert the reduced depth programming data to full depth programming data. In certain embodiments, the receiver, memory and driver are integrally formed on the same substrate as the pixel array.

In a second aspect, a method for operating the above SLM is provided for increasing data transmission efficiency in spatial light modulators. Generally, the method includes or involves: (i) receiving low bit-density input data or reduced depth programming data for each pixel and generating an associated pixel address based on data location within the data sequence; (ii) transmitting the reduced depth programming data to a memory; (iii) converting the reduced depth programming data to full depth programming data using a look-up-table circuitry in the memory; (iv) transmitting the full depth programming data to a driver; and (v) converting the digital full depth programming data to an analog signal to drive the electrostatically operable optical modulators in one of the plurality of pixels to one of a number of discrete modulation levels.

BRIEF DESCRIPTION OF THE DRAWINGS

Embodiments of the present invention will be understood more fully from the detailed description that follows and from the accompanying drawings and the appended claims provided below, where:

FIG. 10A illustrates the relative reduction in data rate obtained with various embodiments of methods for efficient data transmission according to the present disclosure;

FIG. 10B illustrates the per pixel memory size requirement to implement the on-chip memory;

DETAILED DESCRIPTION

Figure 1B:
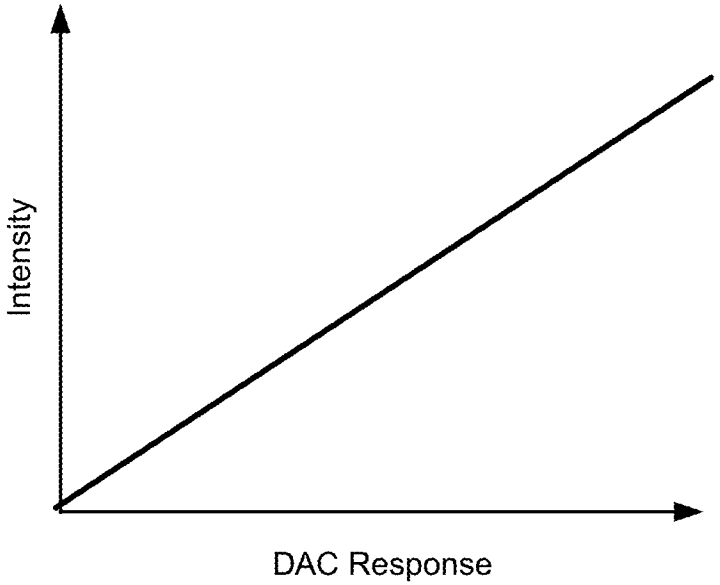
FIGS. 1A and 1*b* are schematic of intensity versus a digital-to-analog converter (DAC) response for a binary spatial light modulator (SLM) and a conventional analog SLM respectively.
Figure 1A:
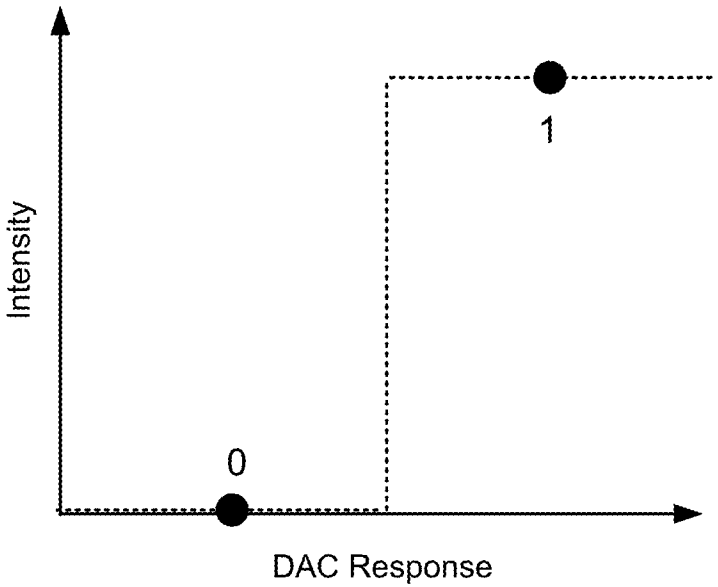

Embodiments of spatial light modulators (SLMs), including memory for converting reduced depth programming data to full depth programming data using a look-up-table circuitry in the memory and methods for operating the same for efficient data transmission are described herein with reference to figures. However, particular embodiments may be practiced without one or more of these specific details, or in combination with other known methods, materials, and apparatuses. In the following description, numerous specific details are set forth, such as specific materials, dimensions and processes parameters etc. to provide a thorough understanding of the present invention. In other instances, well-known semiconductor design and fabrication techniques have not been described in particular detail to avoid unnecessarily obscuring the present invention. Reference throughout this specification to "an embodiment" means that a particular feature, structure, material, or characteristic described in connection with the embodiment is included in at least one embodiment of the invention. Thus, the appearances of the phrase "in an embodiment" in various places throughout this specification are not necessarily referring to the same embodiment of the invention. Furthermore, the particular features, structures, materials, or characteristics may be combined in any suitable manner in one or more embodiments.

The terms "over," "under," "between," and "on" as used herein refer to a relative position of one layer with respect to other layers. As such, for example, one layer deposited or disposed over or under another layer may be directly in contact with the other layer or may have one or more intervening layers. Moreover, one layer deposited or disposed between layers may be directly in contact with the layers or may have one or more intervening layers. In contrast, a first layer "on" a second layer is in contact with that second layer. Additionally, the relative position of one layer with respect to other layers is provided assuming operations deposit, modify and remove films relative to a starting substrate without consideration of the absolute orientation of the substrate.

The spatial light modulator includes a pixel array or an array of a plurality of pixels, each pixel including a one or more electrostatically deflectable optical modulators or diffractors with gray scale capability in which either the phase or intensity of light reflected from the optical modulator is modulated. Generally, the optical modulators are Micro-Electromechanical System (MEMS) based optical modulators, or fabricated using MEMS technology.

Furthermore, the optical modulators can include can be ganged together in either a one-dimensional (1D) or two-dimensional (2-D) array to create a high power spatial light modulator (SLM). Suitable optical modulators include a ribbon-type optical modulator, such as a Grating Light Valve (GLV™), or a Planar Light Valve (PLV™), from Silicon Light Machines, Inc., of Sunnyvale, Calif.

A ribbon-type optical modulator, such as a GLV™, including a number of dielectric mirrors or reflectors formed thereon to modulate a beam of light generated by a laser will now be described with reference to FIGS. 2A-2C. For purposes of clarity, many of the details of optical modulators that are widely known and are not relevant to the present invention have been omitted from the following description. The drawings described are only schematic and are non-limiting. In the drawings, the size of some of the elements may be exaggerated and not drawn to scale for illustrative purposes. The dimensions and the relative dimensions may not correspond to actual reductions to practice of the invention.

Figure 2A:
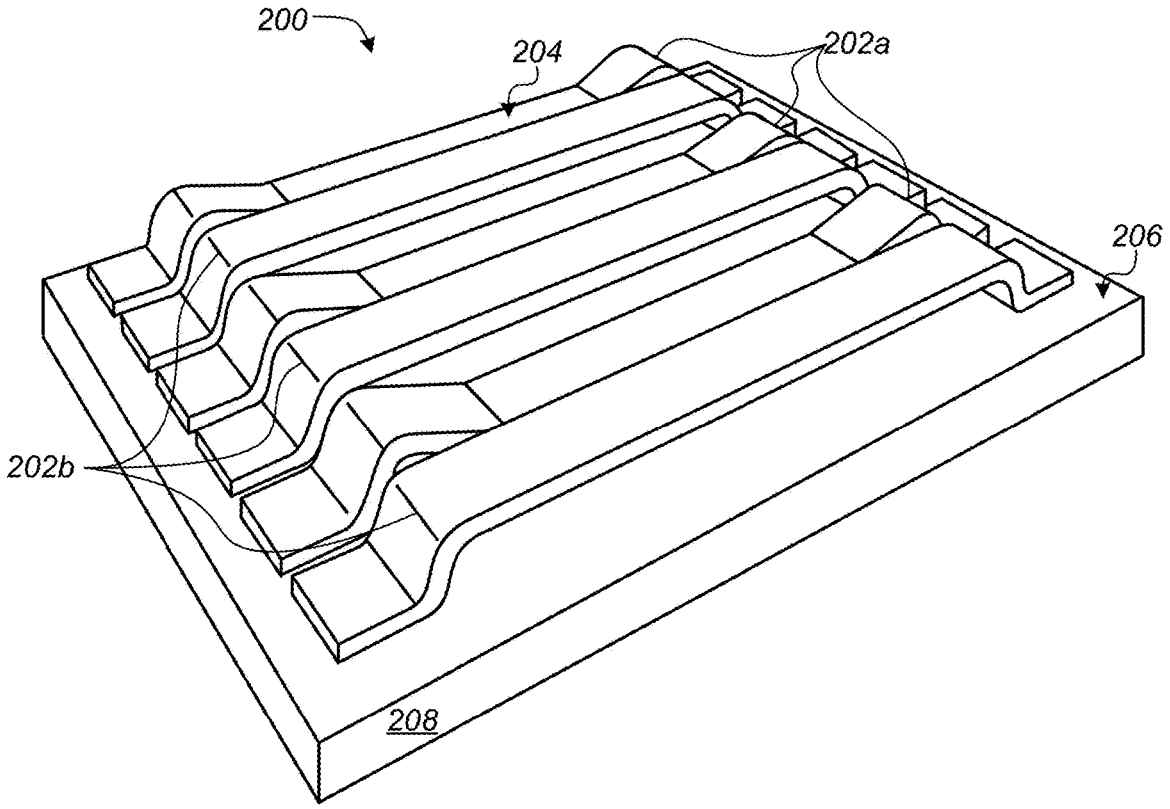
FIG. 2A is a perspective view of an embodiment of a portion of a pixel array of a SLM including ribbon-type optical modulators according to an embodiment of the present disclosure.
Figure 2B:
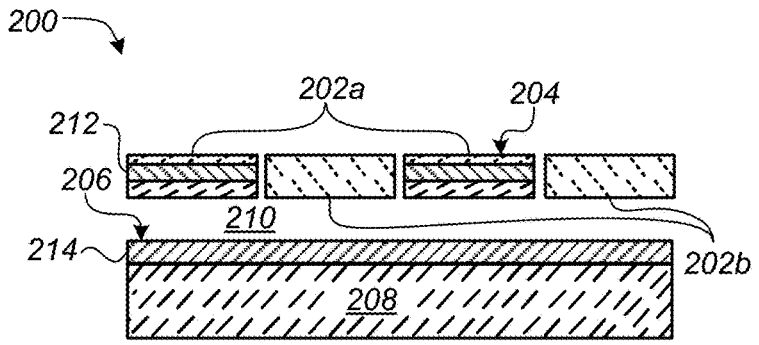
FIGS. 2B and 2C schematic block diagrams of sectional side views of the optical modulators of FIG. 2A.

Referring to FIGS. 2A and 2B, a ribbon-type optical modulator 100 generally includes a number of ribbons 202*a*, 202*b*; each having a light reflective surface 204 supported over a surface 206 of a substrate 208. One or more of the ribbons 202*a* are movable or deflectable through a gap or cavity 210 toward the substrate 208 to form an addressable diffraction grating with adjustable diffraction strength. The ribbons are 202*a* deflected towards the surface 206 of the substrate 208 by electrostatic forces generated when a voltage is applied between electrodes 212 in the deflectable ribbons 202*a* and base electrodes 214 formed in or on the substrate. The applied voltages are controlled by drive electronics (not shown in these figures), which may be integrally formed in or on the surface 206 of the substrate 208 below or adjacent to the ribbons 202. Light reflected from the movable ribbons 202*a* adds as vectors of magnitude and phase with that reflected from stationary ribbons 202*b* or a reflective portion of the surface 206 beneath the ribbons, thereby modulating light reflected from the optical modulator 200.

Figure 2C:
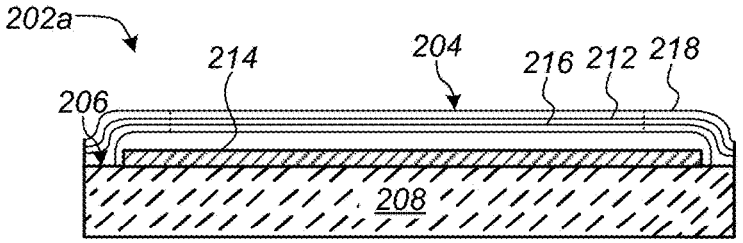

A schematic sectional side view of a movable structure or ribbon 202*a* of the optical modulator 200 of FIG. 2A taken along a longitudinal axis is shown in FIG. 2C. Referring to FIG. 2C, the ribbon 202*a* includes an elastic mechanical layer 216 to support the ribbon above the surface 206 of the substrate 208, an electrode or conducting layer 212 and a reflective surface 204 overlying the mechanical layer and conducting layer. As shown in FIG. 2C, the reflective surface 204 is formed on a separate dielectric mirror or reflector 218 discrete from and overlying the mechanical layer 216 and the conducting layer 212.

Generally, the mechanical layer 216 comprises a taut silicon-nitride film (SiNx), and flexibly supported above the surface 206 of the substrate 208 by a number of posts or structures, typically also made of SiNx, at both ends of the ribbon 202*a*. The conducting layer 212 can be formed over and in direct physical contact with the mechanical layer 216, as shown, or underneath the mechanical layer. The conducting layer 212 or ribbon electrode can include any suitable conducting or semiconducting material compatible with standard MEMS fabrication technologies. For example, the conducting layer 212 can include an amorphous or polycrystalline silicon (poly) layer, or a titanium-nitride (TiN) layer. Alternatively, if the reflective layer 218 is above the conductive layer 212, the conductive layer could also be metallic.

The separate, discrete reflecting layer 218, where included, can include any suitable metallic, dielectric or semiconducting material compatible with standard MEMS fabrication technologies, and capable of being patterned using standard lithographic techniques to form the reflective surface 204.

Figure 3:
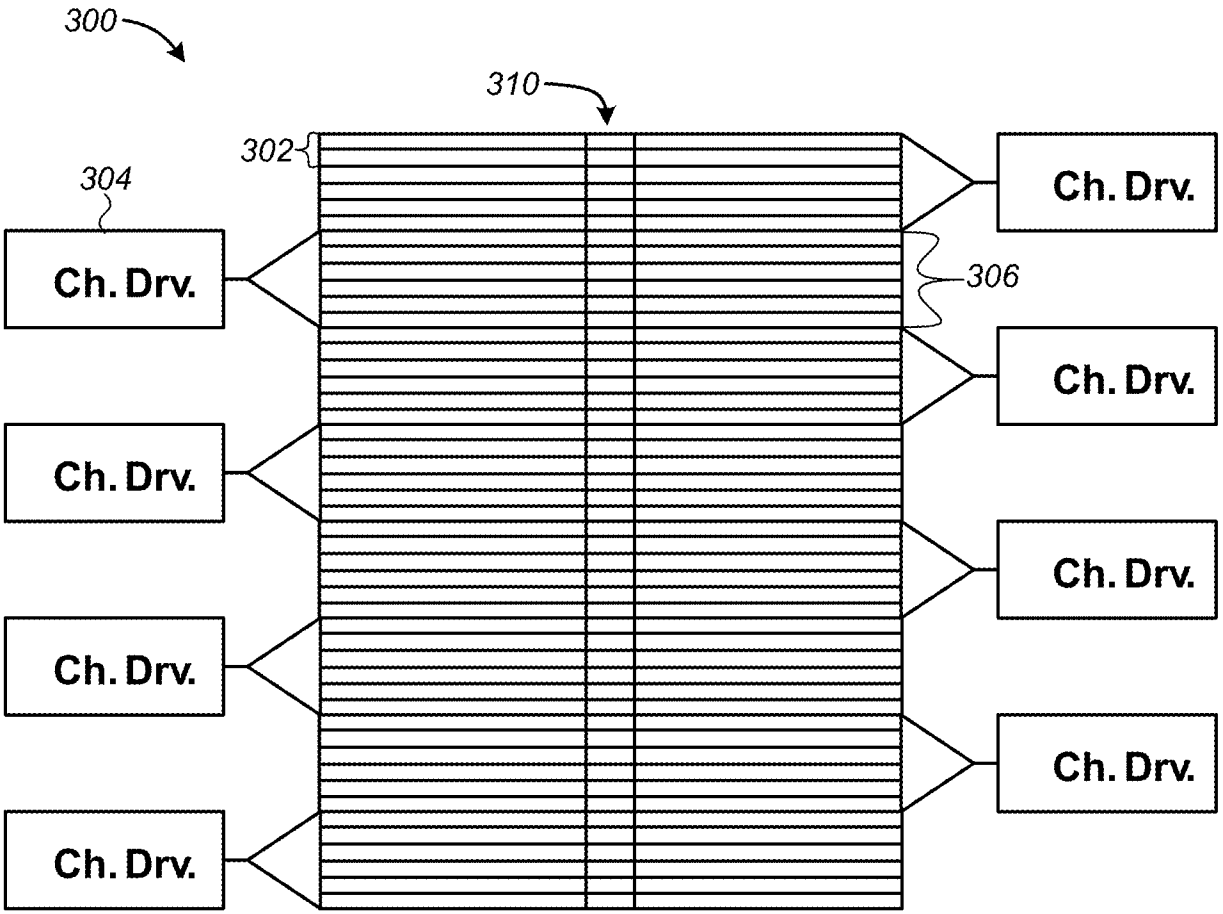
FIG. 3 is a planar top view of a pixel array of a SLM including ribbon-type optical modulators according to an embodiment of the present disclosure.

FIG. 3 shows a linear (1-dimensional) pixel array or array 300 of a number of ribbon-type optical modulators 302 for which a SLM including memory for converting reduced depth programming data to full depth programming data using a look-up-table circuitry in the memory and methods for operating the same is particularly useful. Generally, each optical modulator 302 consists of a number of active (movable) ribbons are interlaced or paired with a number of static bias ribbons. By displacing the active ribbons by a quarter wavelength ($\lambda/4$) relative to the static ribbons coherent light reflected from the active ribbons interferes with that reflected from the static ribbons, and a square-well diffraction grating is formed along the long axis of the array 300. In the embodiment shown, several ribbon pairs are ganged under action of a single driver channel 304 to form a single pixel 306. By assembling a large number of pixels 306 and drivers 304, a continuous, programmable diffraction grating results, such as is particularly useful in printing and lithography applications. Generally, the square-well diffraction grating is established only in a narrow region near the center-line of the array 300 that is truly displaced by a $\lambda/4$. For this reason, illumination onto the array 300 is shaped or focused into a line of illumination 310 near the center-line of the array 300.

Figure 4A:
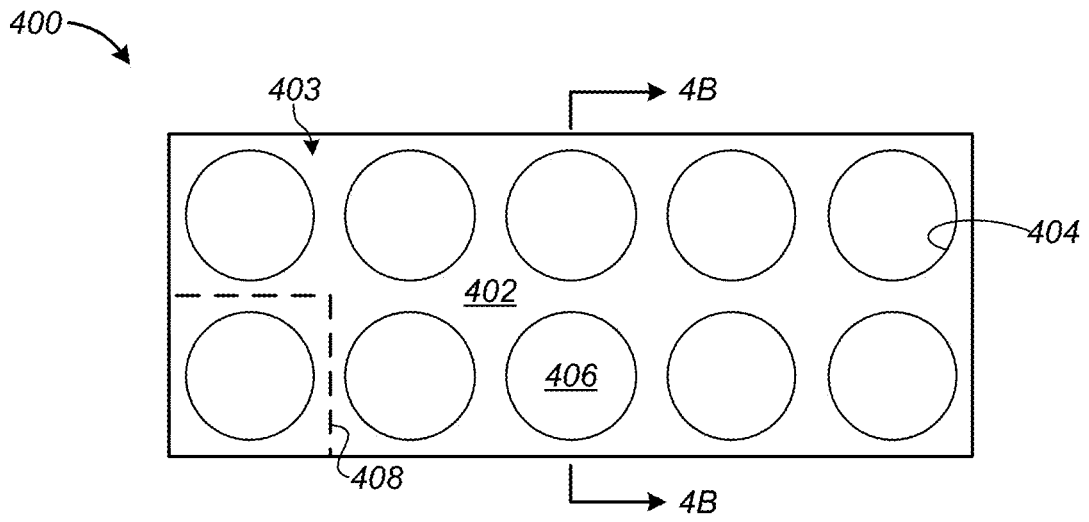
FIG. 4A is a schematic block diagram of another embodiment of an optical modulator according to an embodiment of the present disclosure.
Figure 4B:
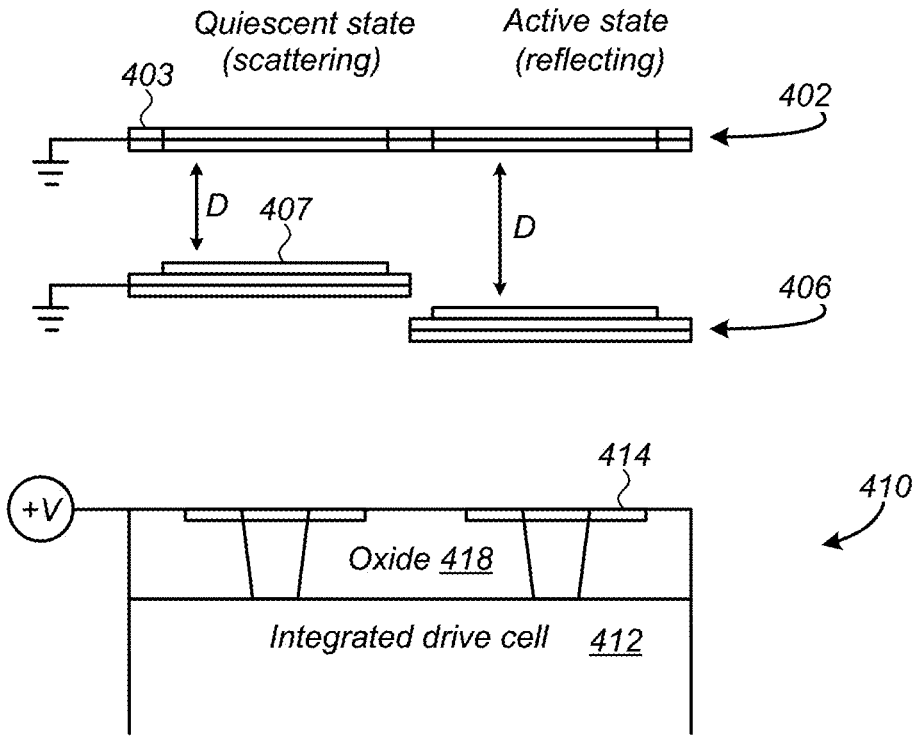
FIG. 4B is a schematic sectional side view of two adjacent modulators of the array of FIG. 4A.

Another type of optical modulator for which the SLM and method of the present invention is particularly useful is a Planar Light Valve or PLV™, commercially available from Silicon Light Machines, Inc., of Sunnyvale, Calif. Referring to FIGS. 4A and 4B, a planar type light valve or PLV™ 400 generally includes two films or membranes having light reflecting surfaces of equal area and reflectivity disposed above an upper surface of a substrate (not shown in this figure). The topmost film is a static tent member or face plate 402 having a uniform, planar sheet of a material with a first planar light reflective dielectric mirror or reflector 403, for example taut silicon-nitride covered on a top surface with one or more layers of material reflective to at least some of the wavelengths of light incident thereon. The face plate 402 has an array of apertures 404 extending from the top dielectric mirror 403 of the member to a lower surface (not shown). The face plate 402 covers an actuator membrane underneath. The actuator membrane includes a number of flat, displaceable or movable actuators 406. The actuators 406 have second planar dielectric mirror or reflector 407 parallel to the first planar dielectric mirror 403 of the face plate 402 and positioned relative to the apertures 404 to receive light passing therethrough. Each of the actuators 406, the associated apertures 204 and a portion of the face plate 202 immediately adjacent to and enclosing the aperture form a single, individual modulator 408 or diffractor. The size and position of each of the apertures 404 are chosen to satisfy an "equal reflectivity" constraint. That is the area of the second dielectric mirror 407 exposed by a single aperture 404 inside is substantially equal to the reflectivity of the area of the individual modulator 408 outside the aperture 404.

FIG. 4B depicts a cross-section through two adjacent modulators 408 of the light valve 400 of FIG. 4. In this exemplary embodiment, the upper face plate 402 remains static, while the lower actuator membrane or actuators 406 move under electrostatic forces from integrated electronics or drive circuitry in the substrate 410. The drive circuitry generally includes an integrated drive cell 412 coupled to substrate or drive electrodes 414 via interconnect 416. An oxide 418 may be used to electrically isolate the electrodes 414. The drive circuitry is configured to generate an electrostatic force between each electrode 414 and its corresponding actuator 406.

Individual actuators 406 or groups of actuators are moved up or down over a very small distance (typically only a fraction of the wavelength of light incident on the light valve 400) relative to first planar dielectric mirror 403 of the face plate 402 by electrostatic forces controlled by drive electrodes 414 in the substrate 410 underlying the actuators 406. Preferably, the actuators 406 can be displaced by $n*\lambda/4$ wavelength, where $\lambda$ is a particular wavelength of light incident on the first and second planar dielectric mirrors 403, 407, and n is an integer equal to or greater than 0. Moving the actuators 406 brings reflected light from the second planar dielectric mirror 407 into constructive or destructive interference with light reflected by the first planar dielectric mirror 403 (i.e., the face plate 402), thereby modulating light incident on the light valve 400.

For example, in one embodiment of the light valve 400 shown in FIG. 4B, the distance (D) between reflective layers of the tent 402 and actuator 406 may be chosen such that, in a non-deflected or quiescent state, the face plate, or more accurately the first dielectric mirror 403, and the actuator (second dielectric mirror 407), are displaced from one another by an odd multiple of $\lambda/4$, for a particular wavelength $\lambda$ of light incident on the light valve 400. This causes the light valve 400 in the quiescent state to scatter incident light, as illustrated by the left actuator of FIG. 4B. In an active state for the light valve 400, as illustrated by the right actuator of FIG. 4B, the actuator 406 may be displaced such that the distance between the dielectric mirrors 403, 407 of the face plate 402 and the actuator 406 is an even multiple of $\lambda/4$ causing the light valve 400 to reflect incident light.

In an alternative embodiment, not shown, the distance (D) between reflective layers of the tent 402 and actuator 406 can be chosen such that, in the actuator's quiescent state, the first and second dielectric mirrors 403, 407 are displaced from one another by an even multiple of $\lambda/4$, such that the light valve 400 in quiescent state is reflecting, and in an active state, as illustrated by the right actuator, the actuator is displaced by an odd multiple of $\lambda/4$ causing it to scatter incident light.

The size and position of each of the apertures 404 are predetermined to satisfy the "equal reflectivity" constraint. That is the reflectivity of the area of a single aperture 404 inside is equal to the reflectivity of the remaining area of the cell that is outside the aperture 404.

Although the light reflective surface of the actuator 406 is shown and described above as being positioned below the light reflective surface 403 of the face plate 402 and between the first reflective surface and the upper surface of the substrate, it will be appreciated that the dielectric mirror 407 of the actuator can alternatively be raised above the movable actuator so as to be positioned coplanar with or above the light reflective surface of the face plate 402.

Figure 5A:
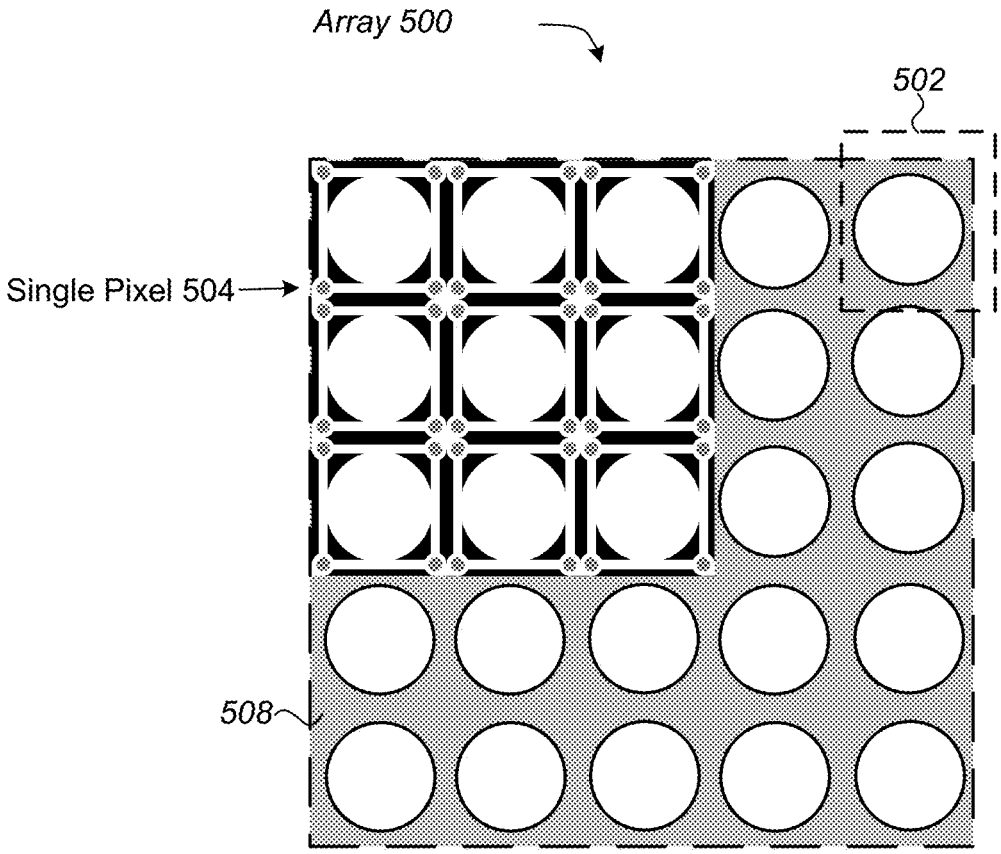
FIG. 5A is a partial top view of embodiment of a portion of a pixel array including Planar Light Valve (PLV™) type optical modulators and showing a cut away view of the actuator layer according to an embodiment of the present disclosure.
Figure 5B:
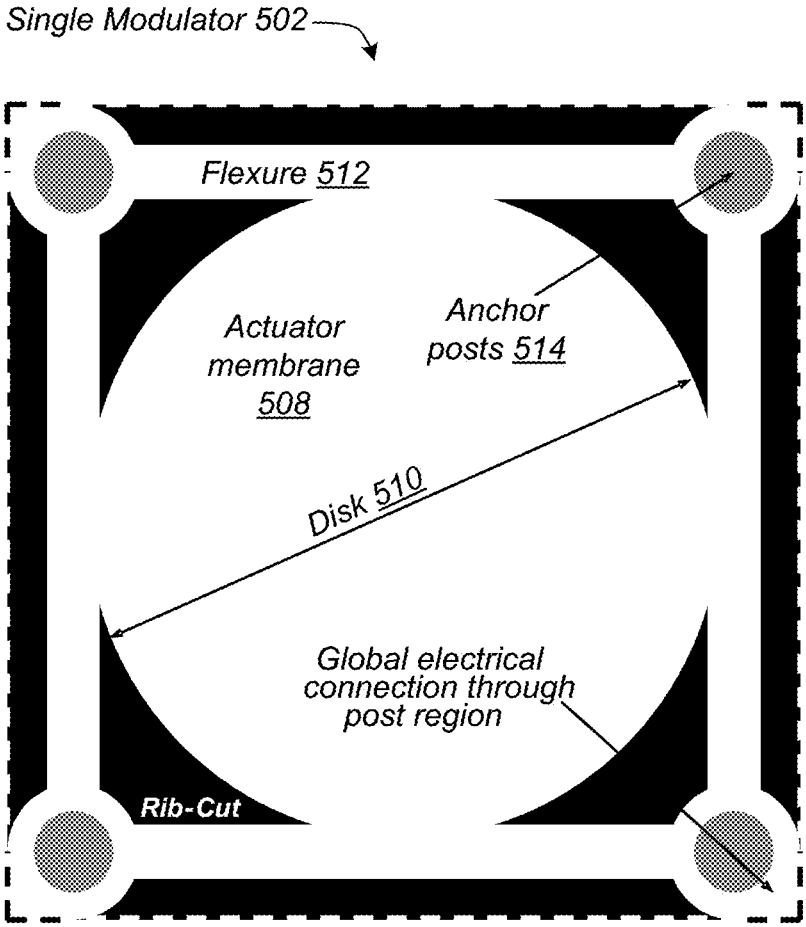
FIG. 5B is a schematic block diagram of a single, individual PLV™ type optical modulator according to an embodiment of the present disclosure.

In one embodiment, shown in FIGS. 5A and 5B, the pixel array or array 500 includes a two dimensional (2D) array of dense-packed, 2D optical modulators 502, such as the PLV™. FIG. 5A shows a portion of the array 500 including a single 3×3 pixel 504 and with a portion of a static tent member or face plate 506 cut away to reveal a portion of an actuator membrane 508 underneath. FIG. 5B is a close up of a single modulator 502 according to an embodiment of the present disclosure. In this embodiment, the actuator membrane is anchored or posted to the underlying substrate at the corner of each actuator. The actuator membrane 508 sparsely or lightly posted to a substrate (not shown in this figure) on which the array 500 is formed at the extremities of the illustrated array.

Referring to FIG. 5B, the optical modulators 502 may include uniform, planar disks 510 each having a planar reflective surface and flexibly coupled by hinges or flexures 512 of an elastic material to one or more posts 514. For example, the planar disks 510 of the actuators 502 may comprise aluminized disks formed from a taut silicon-nitride film, and flexibly coupled to the posts 514 by narrow, non-aluminized flexures 512 of the same silicon-nitride film. Anchoring posts 514 and flexures 512 may be hidden in the area concealed by the overlying face plate 506, thereby providing the PLV™ a large etendue (light gathering power) and substantially 100% diffraction efficiency. Referring to FIG. 4B, the actuator membrane, and the actuators formed therein, also includes, in addition to the aluminum layer and the silicon-nitride (SiN) layer, an electrically conductive film or layer (i.e., titanium-nitride TiN). The conductive layer is electrically coupled to electrical ground in the substrate through one or more of the posts (not shown in this figure), such that a voltage applied to the drive electrode through an integrated drive cell or channel in the substrate deflects actuators toward or away from the substrate. Generally, a single conductor from the drive channel branches into mini-electrodes or drive-electrodes underneath each individual actuator in a single pixel.

Figure 6:
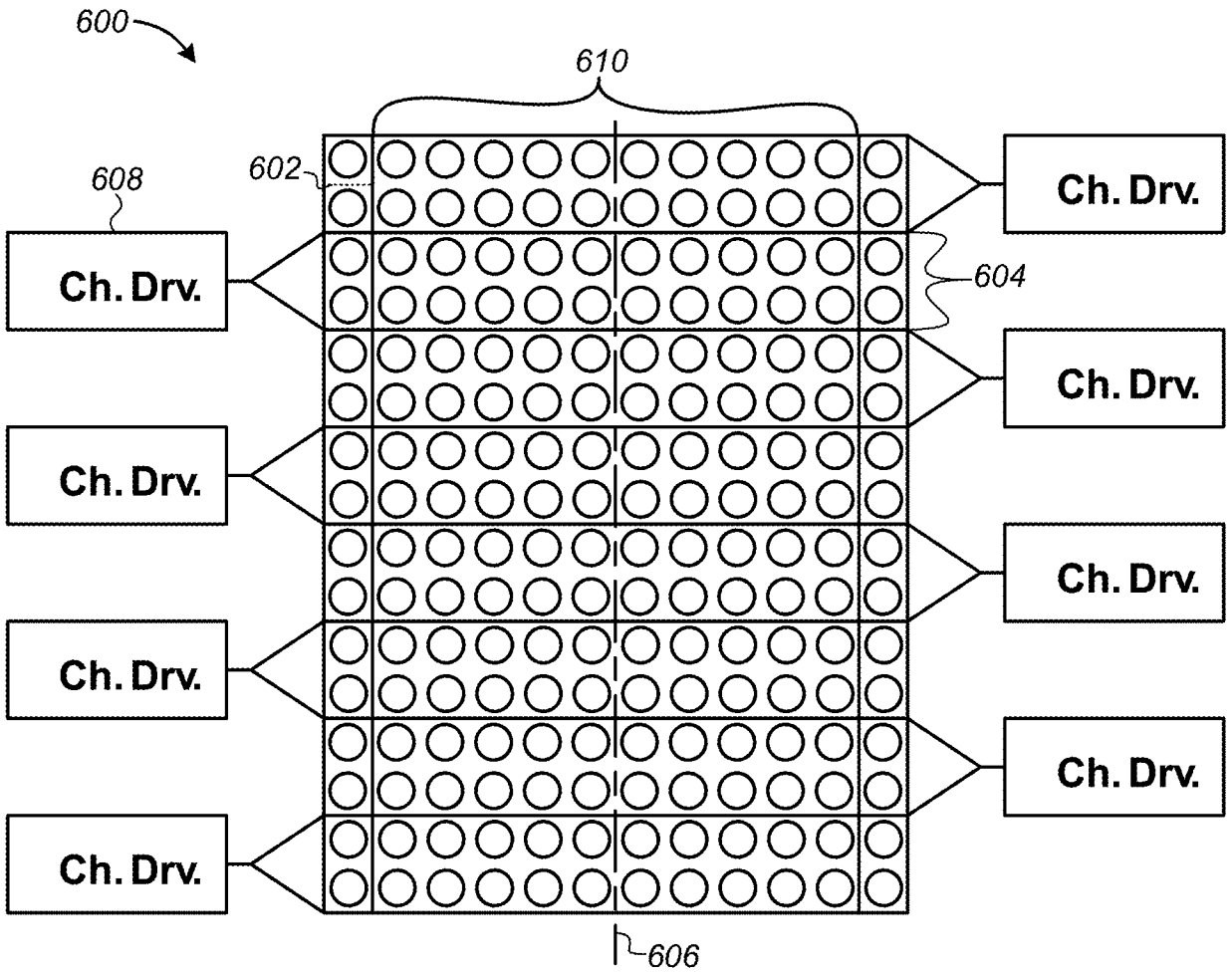
FIG. 6 is a planar top view of a pixel array of a SLM including PLV™ type optical modulators according to another embodiment of the present disclosure.

Referring to FIG. 6, in another embodiment the pixel array or array 600 includes a linear array of dense-packed, 2D modulators 602, such as the PLV™, grouped into a interleaved channels or pixels 604 along a longitudinal axis 606. Each of the 2D modulators 602 in a single pixel 604 share a common drive channel or channel driver (Ch. Drv. 608). Although in the embodiment shown each pixel 604 is depicted as having 2 rows of 12 modulators grouped along a transverse axis perpendicular to the longitudinal axis of the array, it will be appreciated that each channel or pixel can include any number of 2D modulators arranged in any number of rows of any length across the width or transverse axis of the array without departing from the spirit and scope of the invention. Similarly, the array 600 can include a linear array of any number of pixels 604 or a number of linear arrays placed end to end. Because each of the 2D modulators 602 in a pixel 604 is deflected by the same amount, optimally a multiple of a quarter wavelength ($\lambda/4$) of the incident light for maximum diffraction, the width (W) of the illuminated portion 610 of the array 600 can be arbitrarily wide up to or exceeding a length (L) of the pixel 604, with substantially no impact on the contrast or modulation efficiency of the array.

Figure 7:
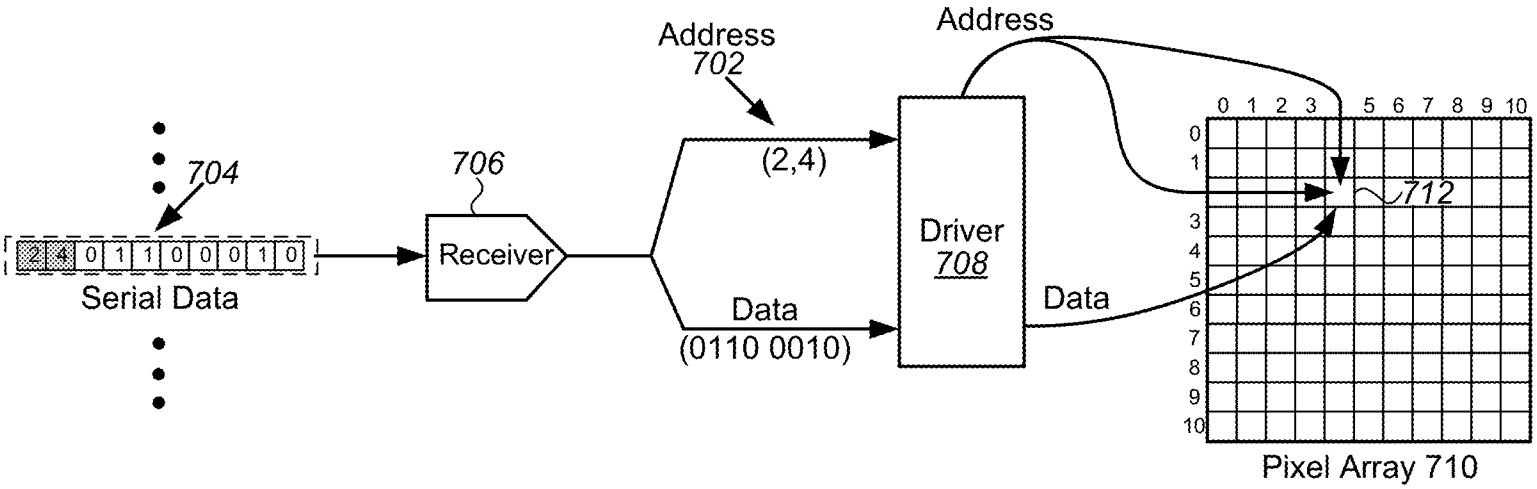
FIG. 7 is schematic diagram illustrating data flow in a conventional analog spatial light modulator.

FIG. 7 is schematic diagram illustrating data flow in a conventional analog spatial light modulator or one in which data is transmitted by conventional scheme. Referring to FIG. 7, serialized digital data 704, consisting of imaging or programming data is input through a receiver 706 and a drive channel or driver 708 to a pixel array or array 710 of a spatial light modulator. The pixel address 702 is implied by a data location within the data sequence, and is generally not transmitted but rather is generated by the receiver 706 based on the data location within the data sequence. In this example, 8-bit data is being written to a two-dimensional array such as a PLV™. The receiver 706 includes circuitry required to process the incoming data, and the driver 708 the circuitry, including a digital-to-analog converter (DAC) to convert the digital programming data 704 to an analog voltage signal to drive the optical modulators in a selected pixel 712 by the desired or programmed amount.

The full bit-depth DAC value is then written into the appropriate pixel address until the entire pixel array 710 is programmed. As noted above, conventional analog SLM's or one in which data is transmitted by conventional scheme typically require much higher data transmission rates. For example, in the embodiment illustrated in FIG. 7 in which each pixel word includes 8 imaging data bits, the data rate is: (8 bits/pixel)×(1000×2000 pixels/frame)*(1000 frames/s)=16 Giga-bits/s. This significantly reduces the response rate of the SLM or forces a user to operate at a lower bit-depth for the DAC, and correspondingly lower resolution.

Figure 8:
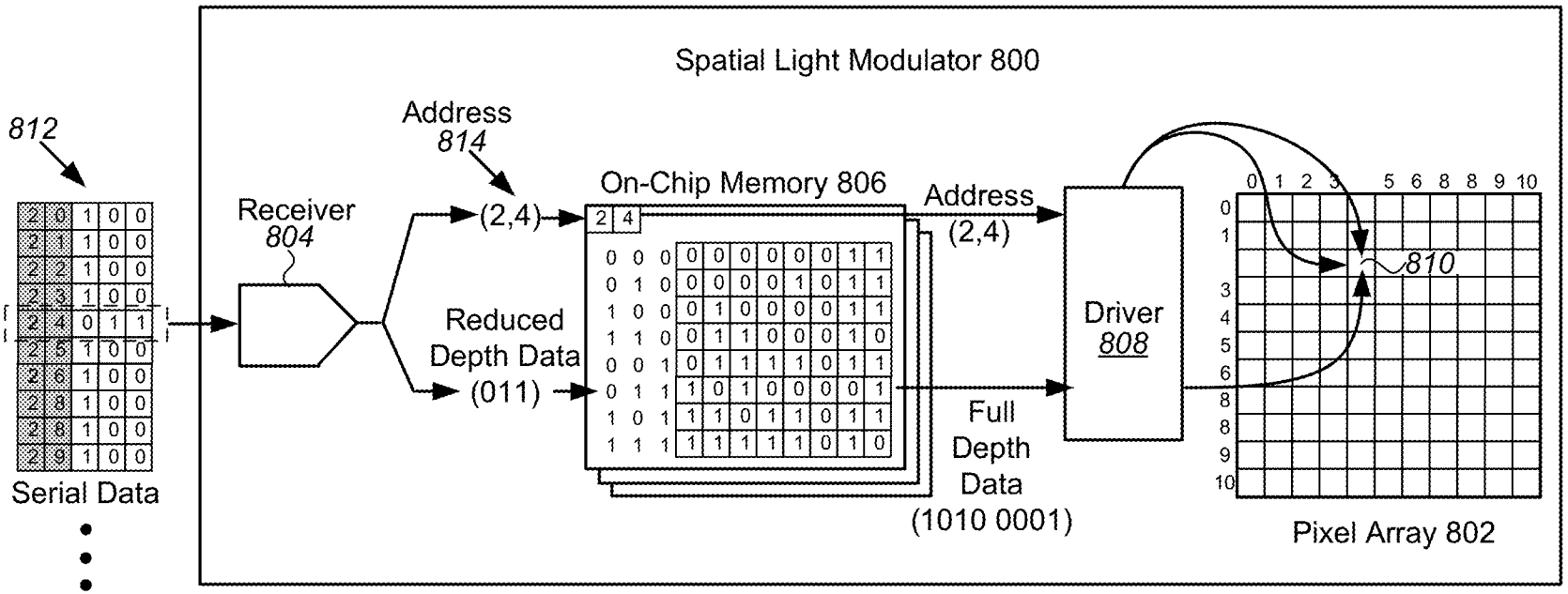
FIG. 8 is schematic diagram illustrating data flow in an analog spatial light modulator according to an embodiment of the present disclosure.

In contrast, in an SLM according to the present invention further includes a memory for converting reduced depth programming data to full depth programming data using a look-up-table circuitry in the memory thereby enabling efficient data transmission. A schematic diagram illustrating data flow in an analog spatial light modulator according to an embodiment of the present invention is shown in FIG. 8. Referring to FIG. 8, the spatial light modulator 800 includes not only the pixel array 802, but also a receiver 804 to receive the serial data, a memory 806 a Look-Up-Table circuitry for converting reduced depth programming data to full depth programming data and a driver 808 to drive the optical modulators in a selected pixel 810 by the desired or programmed amount. The reduced depth programming data is used as an address for reading the Look-Up Table (LUT) memory 806. For each unique reduced depth programming data value in the LUT memory 806, there is an associated full depth programming data value stored in LUT memory. In this manner, a reduced depth programming data is converted to a full depth programming data value.

For systems where each pixel 810 requires calibrated full depth programming data, then a unique LUT memory 806 is allocated for each pixel. The pixel location address that is generated by the receiver 804 is concatenated with the reduced depth programming data to generate an address for reading the Look-Up Table memory 806. For each unique address in the Look-Up-Table memory 806, there is an associated full depth programming data value. In this manner, a reduced depth programming data is converted to a full depth programming data value that is customized for each pixel 810.

In a preferred embodiment, such as that shown, the spatial light modulator 800 is an integrated device in which the receiver 804, memory 806, driver 808 and pixel array 802 are all integrally formed on a single, common substrate (not shown in this figure) and/or packaged in a single multi-chip package. However, it will be understood that need not be the case and that in other embodiments one or more of the receiver 804, memory 806, driver 808 and the pixel array 802 can be discretely formed on separate substrates and/or packaged in separate packages without departing from the scope of the invention.

An embodiment of a scheme for reduced data transmission with bit-depth conversion using a local or on-chip memory will now be described with reference to FIG. 8. FIG. 8 shows the transmission of serial data into the spatial light modulator 800. Again, the serialized digital data includes imaging or programming data 814 is input through the receiver 804, and a pixel address 814 is implied by a data location within the data sequence, and is generally not transmitted but rather is generated by the receiver 804 based on the data location within the data sequence. In this embodiment, however, the imaging or programming data 814 includes only one of eight pre-set intensity levels. These pre-set intensity levels can be described using 3-bit input code resulting in a data rate which is only $3/8^{th}$ of the original or full depth data rate or a 62.5% savings. The 3-bit input code is used to select one of eight 8-bit pre-set values which are stored in local memory for each pixel. The values populating the look-up-table are written when the SLM 800 is off-line (i.e. during configuration). During operation, the full 8-bit value is read from memory in real-time and written to the appropriate pixel location using the address bits in the same manner as before.

Figure 9:
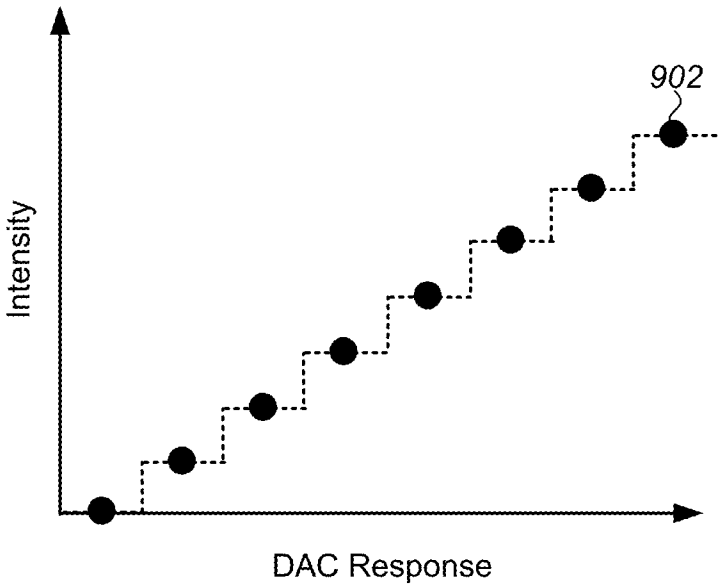
FIG. 9 is a schematic of the intensity versus a DAC response for an analog modulator with select intensity levels according to an embodiment of the present disclosure.

FIG. 9 is a schematic of the intensity versus a DAC response for an analog modulator with select intensity levels according to an embodiment of the present disclosure. Referring to FIG. 9 it is seen that while each level 902 of the eight discrete levels require precise intensity control (i.e. 10-bit), only a handful of such intensity levels are required for each pixel, thereby enabling a substantial reduction in data rate of data transmitted to the SLM 800.

The reduction in data rate obtained with various embodiments of methods for efficient data transmission according to the present disclosure will now be described with reference to FIGS. 10A and 10B. In particular, FIG. 10A illustrates the relative reduction in data rate obtained with various embodiments of methods for efficient data transmission according to the present disclosure. FIG. 10B illustrates the per pixel memory size requirement to implement the on-chip memory. Referring to 10A and 10B it is seen that the greatest data rate savings are achieved when a small subset of intensity levels are employed with high bit-depth calibrated levels (i.e. a 10× data rate reduction is achieved using two calibrated 10-bit amplitude levels). Correspondingly, the amount of memory required per pixel increases with both the input and output bit depth. The example outlined above (3-bit representation of 8-bit amplitudes) is highlighted in green. It yields a 62.7% reduction in data rate using 64 bits of on-board memory per pixel. Obviously, a tradeoff must be struck between the costs associated with higher data rates vs the additional chip cost (i.e. area) associated with the on-board memory. In advanced complementary metal-oxide-semiconductor (CMOS) fabrication processes, however, dense memory arrays are readily available and inexpensive and can reduce overall system costs by allowing the use of lower speed, less expensive upstream components such as serializer-deserializers and field-programmable gate arrays (FPGAs). The reduction data rate obtainable with a 3-bit representation of 8-bit data is highlighted in the boxes shaded in gray.

Figure 11:
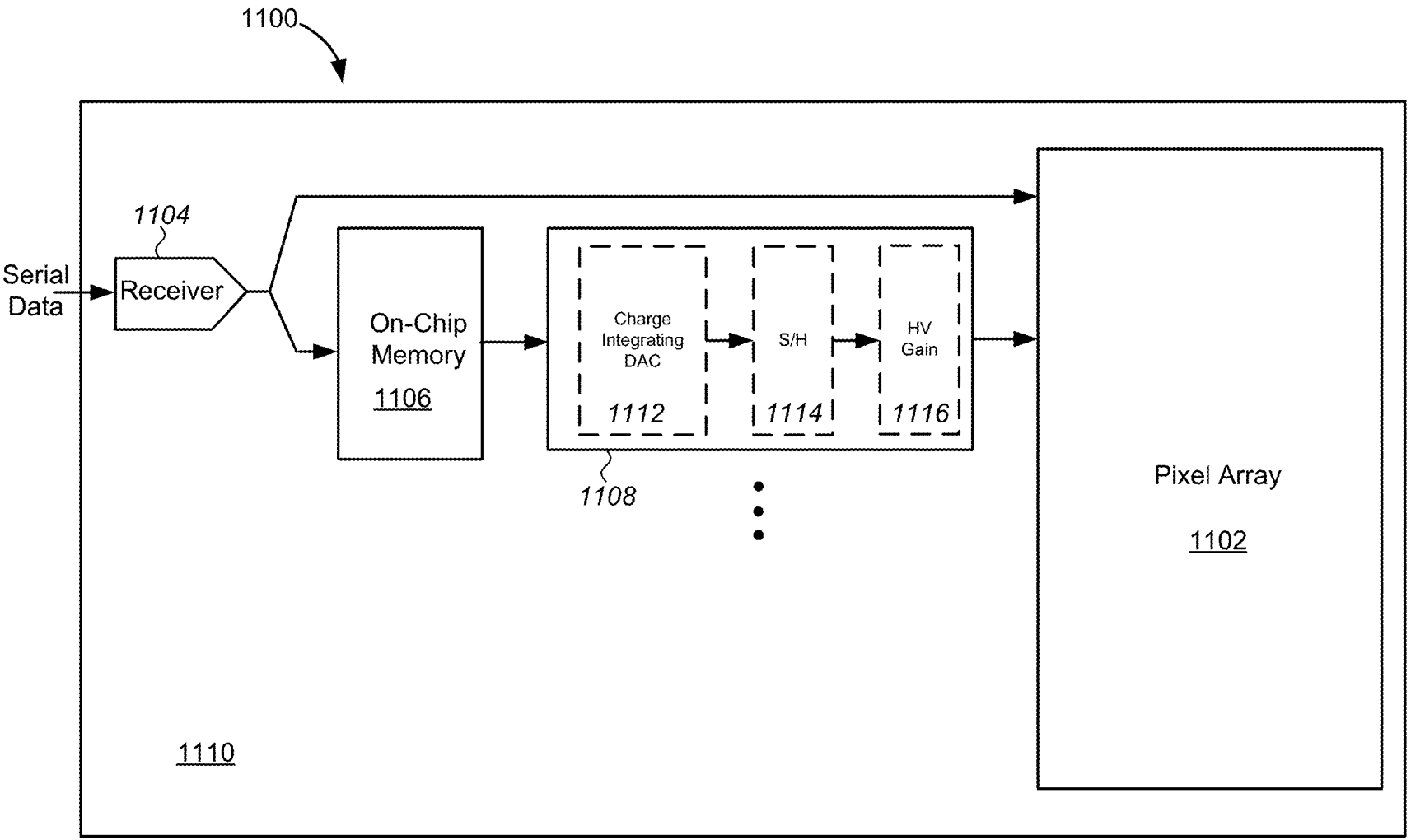
FIG. 11 is block diagram of a spatial light modulator including a pixel array a receiver, an on-chip memory and a driver integrally formed on a common substrate.

An integrated spatial light modulator 1100 including a pixel array 1102 a receiver 1104, an on-chip memory 1106 and a driver 1108 integrally formed on a single, common substrate 1110 will now be described with reference to FIG. 11. Referring to FIG. 11, the receiver 1104 includes circuitry for receiving reduced depth programming data in a predetermined sequence, whereby the location of the programming data in the received data sequence implies the associated pixel address within the pixel array. In this manner, the receiver may generate a pixel location address for each "reduced depth programming data value" that is received. The circuitry of the receiver 1104 can be integrally formed on the substrate 1110 using CMOS technology and standard semiconductor fabrication techniques.

The on-chip memory 1106 may include any suitable semiconductor memory capable of being integrally formed on the substrate 1110 with the receiver 1104, driver 1108 and pixel array 1102 using standard semiconductor fabrication techniques, and configured to in include one or more look-up tables. The on-chip memory 1106 may include, for example, a read only memory (ROM) in which the data in the look-up table is entered once after the SLM 1100 is calibrated following manufacture of the device. Alternatively, the on-chip memory 1106 can include a volatile random access memory, in which the data can be re-entered following calibration of the SLM 1100 or device including the SLM to compensate for non-uniformity or diminution of the light-source.

Referring to FIG. 11, the driver 1108 generally includes a charge integrating digital to analog converter (DAC 1112) to convert the digital full depth programming data to an analog signal, a sample and hold stage (S/H 1114) to generally includes at least one internal (DAC 1112) coupled to sample-and-hold (S/H) stage 1114 including one or more S/H sub-circuits or sub-stages, and an high voltage output stage (HVO 1116) to drive one or more optical modulators (not shown in this figure) in the pixel array 1102.

Figure 12:
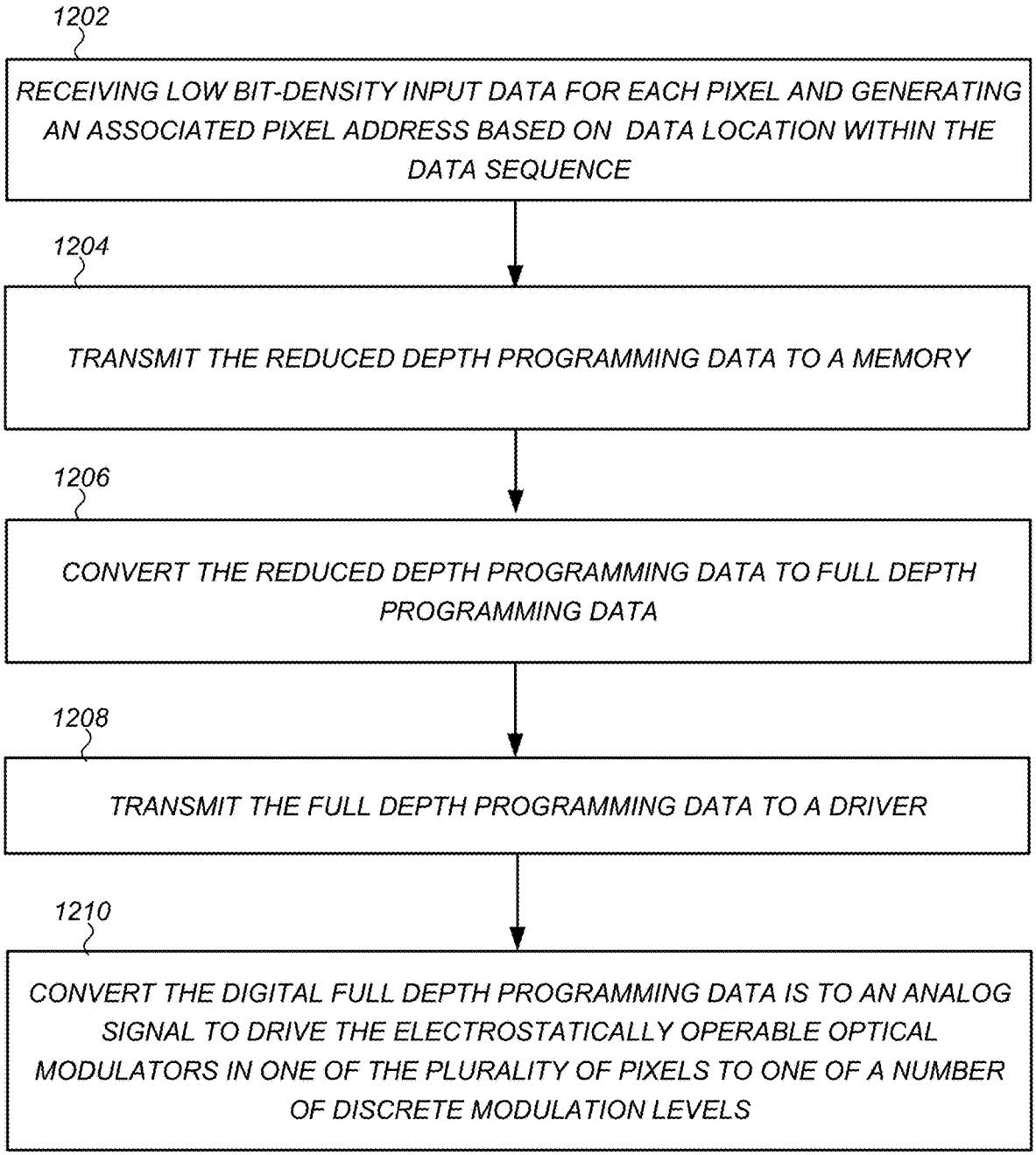
FIG. 12 is a flowchart illustrating a method for efficient data transmission in an analog spatial light modulator according to an embodiment of the present disclosure.

A method a for efficient data transmission in an analog spatial light modulator according to an embodiment of the present disclosure will now be described with reference to the flow chart of FIG. 12. Referring to FIG. 12, the method begins with receiving low bit-density input data for each pixel and generating an associated pixel address based on data location within the data sequence (step 1202). Next, the reduced depth programming data is transmitted to a memory (step 1204), where it is converted to full depth programming data using a look-up-table circuitry in the memory (step 1206). The full depth programming data is then transmitted to a driver (step 1208), where the digital full depth programming data is converted to an analog signal to drive the electrostatically operable optical modulators in one of the plurality of pixels to one of a number of discrete modulation levels (step 1210). As noted above the reduced depth programming data can include a bit-depth of from 1 to 8 bits, while the full depth programming data can include a bit-depth of from 1 to 18 bits.

Thus, embodiments of a spatial light modulator (SLM), including memory for converting reduced depth programming data to full depth programming data using a look-up-table circuitry in the memory and methods for operating the same for efficient data transmission have been described. Although the present disclosure has been described with reference to specific exemplary embodiments, it will be evident that various modifications and changes may be made to these embodiments without departing from the broader spirit and scope of the disclosure. Accordingly, the specification and drawings are to be regarded in an illustrative rather than a restrictive sense.

The Abstract of the Disclosure is provided to comply with 37 C.F.R. § 1.72(b), requiring an abstract that will allow the reader to quickly ascertain the nature of one or more embodiments of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

Reference in the description to one embodiment or an embodiment means that a particular feature, structure, or characteristic described in connection with the embodiment is included in at least one embodiment of the circuit or method. The appearances of the phrase one embodiment in various places in the specification do not necessarily all refer to the same embodiment.

What is claimed is:

1. A method of operating a spatial light modulator including an array of a plurality of pixels, each pixel including a one or more electrostatically operable optical modulators, the method comprising:

receiving within a data sequence reduced depth programming data for each pixel and generating an associated pixel address based on data location within the data sequence;

transmitting the reduced depth programming data to a memory;

converting the reduced depth programming data to full depth programming data using a look-up-table circuitry in the memory, the look-up-table circuitry including a plurality of look-up-table (LUT) addresses with full depth programming data stored at each LUT address, and converting the reduced depth programming data comprises looking up the full depth programming stored at one of the plurality of LUT addresses provided in the reduced depth programming data;

transmitting the full depth programming data to a driver coupled to memory; and converting the full depth programming data to an analog signal using the driver to drive the electrostatically operable optical modulators in one of the plurality of pixels to one of a number of discrete modulation levels, wherein the memory, driver and the array of the plurality of pixels are integrally formed on a single substrate.

2. The method of claim 1 wherein the reduced depth programming data comprises a bit-depth of from 1 to 8 bits.

3. The method of claim 2 wherein the full depth programming data comprises a bit-depth of from 1 to 18 bits.

4. The method of claim 1 wherein the spatial light modulator is a ribbon-type analog spatial light modulator.

5. The method of claim 1 wherein the spatial light modulator is a Planar Light Valve (PLV™) analog spatial light modulator.

6. A spatial light modulator comprising:

an array of a plurality of pixels formed on a substrate, each pixel including one or more electrostatically operable optical modulators;

a receiver to receive a string of reduced depth programming data;

a memory including look-up-table circuitry coupled to the receiver, the look-up-table circuitry including a plurality of look-up-table (LUT) addresses with full depth programming data stored at each LUT address, used to convert the reduced depth programming data to full depth programming data by looking up the full depth programming stored at one of the plurality of LUT addresses provided in the reduced depth programming data; and a driver including a number of drive channels coupled to the memory, each of the drive channels coupled to one of the plurality of pixels, wherein each of the drive channels comprises a digital-to-analog-converter (DAC) configured to receive the full depth programming data from the memory and to generate a voltage to drive the electrostatically operable optical modulators in the pixel to one of a number of discrete modulation levels, wherein the memory and driver are integrally formed on the same substrate as the array.

7. The spatial light modulator of claim 6 wherein the reduced depth programming data comprises a bit-depth of from 1 to 8 bits.

8. The spatial light modulator of claim 7 wherein the full depth programming data comprises a bit-depth of from 1 to 18 bits.

9. The spatial light modulator of claim 6 wherein the driver comprises a number of charge integrating digital-to-analog converters (DACs), a number of sample and hold stages (S/H), and a number of high voltage output stages integrally formed on the same substrate as the array to drive one or more optical modulators in the array.

10. The spatial light modulator of claim 6 wherein the spatial light modulator is configured to drive one or more optical modulators in the array with full depth programming data at a data rate at least three (3) times that at which the reduced depth programming data is received.

11. The spatial light modulator of claim 6 wherein the electrostatically operable optical modulators comprise ribbon-type analog spatial light modulators.

12. The spatial light modulator of claim 6 wherein the electrostatically operable optical modulators comprise Planar Light Valve (PLV™) analog spatial light modulators.

13. A method of operating a spatial light modulator (SLM) including an array of a plurality of pixels, each pixel including a one or more electrostatically operable optical modulators, the method comprising:

receiving in a receiver reduced depth programming data, wherein the reduced depth programming data comprises a pixel address for at least one pixel in the array and a memory address for a memory integrally formed on a substrate with the array and the receiver;

transmitting the memory address to the memory and transmitting the pixel address to a driver integrally formed on the substrate with the array, receiver and the memory;

converting the reduced depth programming data to full depth programming data for the at least one pixel by retrieving the full depth programming data from the memory at the memory address in reduced depth programming data;

transmitting the full depth programming data for the at least one pixel to the driver;

converting the full depth programming data to an analog signal using the driver; and driving the electrostatically operable optical modulators in the pixel associated with the pixel address to one of a number of discrete modulation levels using the analog signal.

14. The method of claim 13 wherein converting the full depth programming data to an analog signal comprises:

converting a first digital value to a first voltage using a digital-to-analog converter (DAC);

sampling and holding the first voltage using a sampling and holding (S/H) stage; and amplifying the first voltage held in the S/H stage to a higher voltage using a high voltage (HV) stage, wherein the DAC, S/H stage and HV stage are integrally formed on the substrate with the array, receiver and the memory.

15. The method of claim 13 wherein the reduced depth programming data comprises a bit-depth of from 1 to 8 bits.

16. The method of claim 15 wherein the full depth programming data comprises a bit-depth of from 1 to 18 bits.

17. The method of claim 13 wherein the spatial light modulator is a ribbon-type analog spatial light modulator.

18. The method of claim 13 wherein the spatial light modulator is a Planar Light Valve (PLV™) analog spatial light modulator.

19. The method of claim 13 wherein the full depth programming data is transmitted to the driver at a data rate at least three (3) times that at which the reduced depth programming data is received by the receiver.

* * * * *